US006769478B2

(12) United States Patent
Yoo

(10) Patent No.: US 6,769,478 B2
(45) Date of Patent: Aug. 3, 2004

(54) RADIATOR HAVING A COVER FOR COVERING A TOP TANK

(75) Inventor: Jeong-Bong Yoo, Busan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/216,265

(22) Filed: Aug. 9, 2002

(65) Prior Publication Data

US 2003/0037916 A1 Feb. 27, 2003

(30) Foreign Application Priority Data

Aug. 21, 2001 (KR) ..... 2001-50280

(51) Int. Cl.[7] ..... F28F 9/02
(52) U.S. Cl. ..... 165/149; 165/134.1
(58) Field of Search ..... 165/134.1, 149

(56) References Cited

U.S. PATENT DOCUMENTS 1,019,122 A * 6/1912 Beam ..... 313/357
1,101,634 A * 6/1914 Kempster ..... 165/149
1,522,376 A * 1/1925 Laird ..... 165/149
1,593,244 A * 7/1926 Cutler ..... 165/69
1,829,374 A * 10/1931 Saunders ..... 165/44
2,065,515 A * 12/1936 Cornell, Jr. ..... 165/83
5,570,737 A * 11/1996 Tokutake ..... 165/67

FOREIGN PATENT DOCUMENTS

DE 200056 A * 7/1908 ..... 165/149
DE 441144 A * 2/1927 ..... 165/149
EP 567401 A1 * 4/1993 ..... F28F/9/00

* cited by examiner

*Primary Examiner*—Allen Flanigan
(74) *Attorney, Agent, or Firm*—Morgan Lewis & Bockius LLP

(57) ABSTRACT

The present invention provides a radiator that comprises: a radiator core for irradiating heat from coolant into the atmosphere; a top tank and a bottom tank respectively disposed at an upper portion and a lower portion of the radiator core; and a cover member mounting to the top tank and extending from an upper portion of the top tank to a lower portion of the top tank such that it covers the top tank.

5 Claims, 2 Drawing Sheets

RADIATOR HAVING A COVER FOR COVERING A TOP TANK

FIELD OF THE INVENTION

The present invention relates to a radiator, and more particularly, to a radiator of a vehicle having a cover for covering a top tank of the radiator in order to protect the top tank from foreign particles and substances.

BACKGROUND OF THE INVENTION

A radiator is a device for irradiating heat of an engine into the atmosphere by circulating coolant through the engine and the radiator. The radiator is generally mounted in the engine compartment. Therefore, substances such as calcium chloride are deposited on the top tank of the radiator, and the calcium chloride corrodes the radiator top tank in particular such that cracks may develop. Thus, in the winter season, coolant often leaks because of such cracks in the top tank of the radiator.

Attempts to solve such problems have included seals or plates between the top tank and radiator. However, such attempted solutions cause an increase in manufacturing costs, and do not totally solve the problem of the top tank being exposed to foreign substances.

SUMMARY OF THE INVENTION

In a preferred embodiment of the present invention, a radiator comprises a radiator core, a top tank, a bottom tank, and a cover member. The radiator core irradiates heat from coolant into the atmosphere; the top tank and a bottom tank are respectively disposed at an upper portion and a lower portion of the radiator core; and the cover member is mounted to the top tank and extends from an upper portion of the top tank to a lower portion of the top tank, such that it covers the top tank.

It is preferable that the radiator further comprise reinforcing members mounted to both ends of the radiator core for increasing structural integrity of the radiator. More preferably, one edge portion of the cover member is mounted to the upper portion of the top tank, and the other edge portion of the cover member is provided with a bent portion through which the cover member is connected to a plate disposed between the top tank and the radiator core. It is further preferable that the cover member is connected to a hook member integrally formed in the upper portion of the top tank.

In a further preferred embodiment, a radiator comprises a radiator core, a top tank disposed above the radiator core and communicating therewith, a plate disposed between the top tank and radiator core, and a cover member extending around at least a portion of the top tank and a portion of the plate. Preferably, the cover member is secured at one edge along a top surface of the top tank and along an opposite edge to a bottom surface of the plate. The opposite edge of the cover member may be bent upward to engage the plate.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
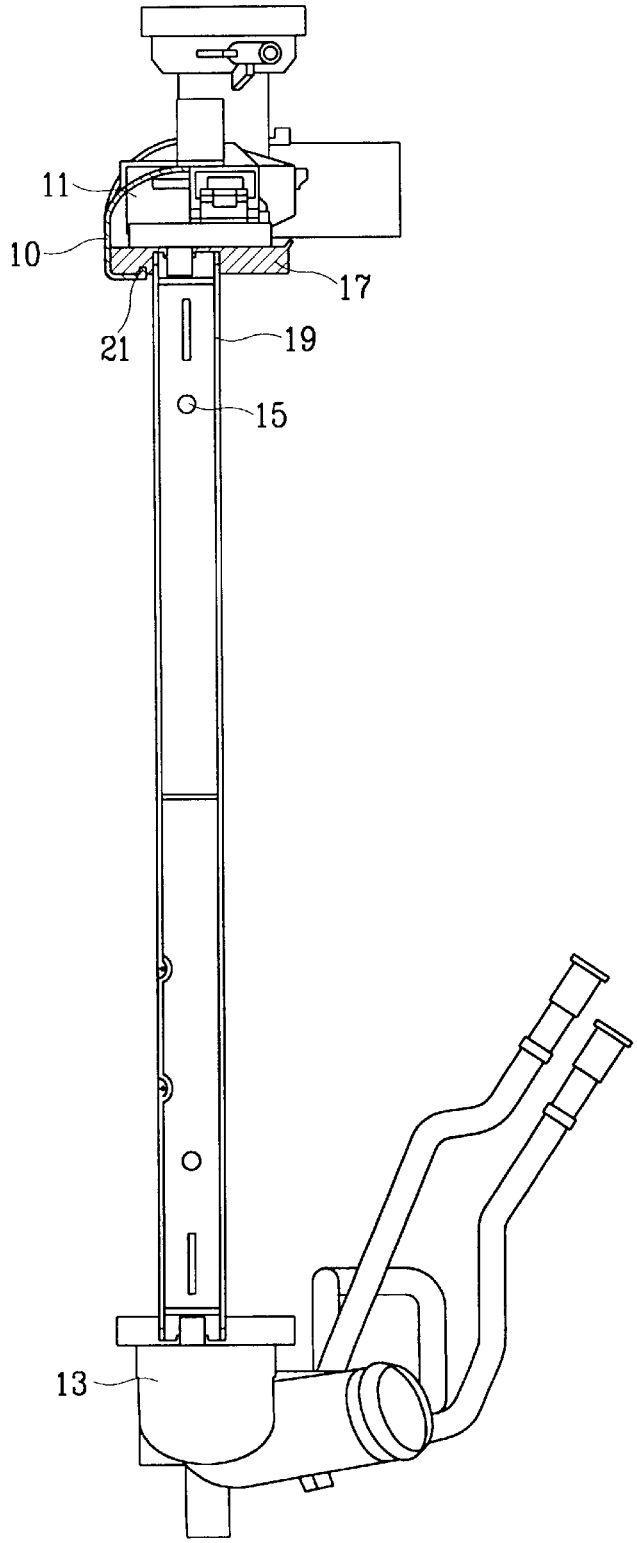
FIG. 1 schematically shows the radiator having the radiator cover according to the present invention.
Figure 2:
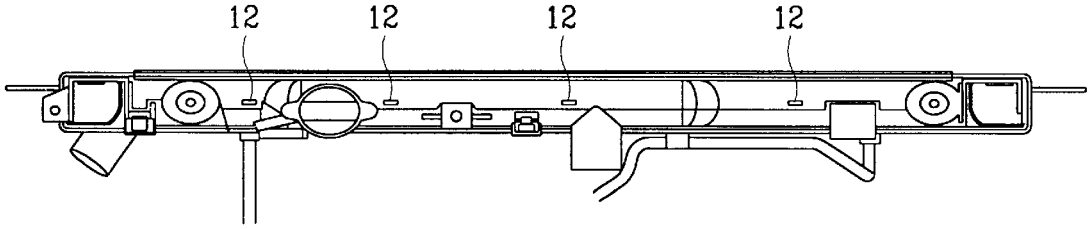
FIG. 2 is a plan view of the radiator of FIG. 1.

As shown in FIGS. 1 and 2, a radiator according to a preferred embodiment of the invention includes a radiator core 15, a top tank 11, a bottom tank 13, and a cover member 10. The radiator core 15 consists of a series of thin tubes and fins, and it irradiates heat from coolant into the atmosphere. The top tank 11 is disposed at an upper portion of the radiator core 15, and the bottom tank 13 is disposed at a lower portion of the radiator core 15.

A radiator of the preferred embodiment of the present invention further comprises a pair of reinforcing members 19, that are disposed on both ends of the radiator core 15 for increasing the structural integrity of the radiator.

An upper edge of the cover member 10 is, as shown in FIG. 1, connected to an upper portion of the top tank 11, and a lower edge of the cover member 10 is secured to a plate 17 that is disposed between the top tank 11 and the radiator core 15. Consequently, the cover member 10 covers the top tank 11. A bent portion 21 is provided at the lower edge of the cover member 10, and as shown in FIG. 2, a plurality of hook members 12 are formed on the top of the top tank 11. The cover member 10 is firmly and separably connected to the plate 17 through the bent portion 21, and to the top tank 11 through the hook members 12.

The cover member 10 according to a preferred embodiment of the present invention plays a role in preventing the top tank corrosion due to substances such as calcium chloride by covering the top tank 11. Furthermore, even when the cover member 10 is corroded by calcium chloride, it can be easily changed.

Although preferred embodiments of the present invention have been described in detail hereinabove, it should be clearly understood that many variations and/or modifications of the basic inventive concepts herein taught which may appear to those skilled in the present art will still fall within the sprit and scope of the present invention, as defined in the appended claims.

What is claimed is:

1. A radiator for a vehicle, comprising:

a radiator core for irradiating heat from coolant into the atmosphere;

a top tank and a bottom tank respectively disposed at an upper portion and a lower portion of the radiator core; and a cover member mounted to the top tank and extending from an upper portion of the top tank to a lower portion of the top tank such that it covers the top tank;

wherein one edge portion of the cover member is mounted to the upper portion of the top tank, and an opposite edge portion of the cover member is provided with a bent portion through which the cover member is connected to a plate disposed between the top tank and the radiator core; and wherein said cover member is secured at one edge along a top surface of the top tank and along an opposite edge to a bottom surface of the plate.

2. The radiator of claim 1, further comprising reinforcing members mounted on both ends of the radiator core for increasing structural integrity of the radiator.

3. The radiator of claim 1, wherein the cover member is connected to a hook member integrally formed in the upper portion of the top tank.

4. A radiator for a vehicle comprising:

a radiator core;

a top tank disposed above the radiator core and communicating therewith;

a plate disposed between the top tank and radiator core; and a cover member extending around at least a portion of the top tank and a portion of said plate;

wherein said cover member is secured at one edge along a top surface of the top tank and along an opposite edge to a bottom surface of the plate.

5. The radiator of claim 4, wherein said opposite edge of the cover member is bent upward to engage said plate.

* * * * *